US010948194B2

(12) United States Patent
Kendall

(10) Patent No.: US 10,948,194 B2
(45) Date of Patent: Mar. 16, 2021

(54) AUTOMATIC DISCONNECT FOR CABLE IN OVEN APPLIANCE DOOR

(71) Applicant: Haier US Appliance Solutions, Inc., Wilmington, DE (US)

(72) Inventor: Anthony E. Kendall, Ooltewah, TN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 68 days.

(21) Appl. No.: 16/245,359

(22) Filed: Jan. 11, 2019

(65) Prior Publication Data

US 2020/0224885 A1 Jul. 16, 2020

(51) Int. Cl.

| | |
|---|---|
| ***F24C 15/02*** | (2006.01) |
| ***H01R 13/703*** | (2006.01) |
| ***F24C 3/12*** | (2006.01) |
| ***F24C 7/08*** | (2006.01) |

(52) U.S. Cl.

CPC ..... *F24C 15/023* (2013.01); *F24C 3/128* (2013.01); *F24C 7/085* (2013.01); *H01R 13/703* (2013.01)

(58) Field of Classification Search

CPC ..... F24C 15/023; F24C 3/128; F24C 7/085; H01R 13/703

See application file for complete search history.

(56) References Cited

U.S. PATENT DOCUMENTS

| | | | | |
|---|---|---|---|---|
| 3,299,879 | A * | 1/1967 | Doner | F24C 15/023 126/194 |
| 6,745,911 | B1 * | 6/2004 | Maestranzi | B61G 5/10 213/75 R |
| 7,134,169 | B2 * | 11/2006 | Habegger | E05D 7/123 16/297 |
| 10,054,316 | B2 | 8/2018 | Gutierrez et al. | |
| 2013/0033360 | A1 * | 2/2013 | Kurtz | G07C 9/00944 340/5.62 |
| 2017/0000292 | A1 * | 1/2017 | Park | H04N 5/2257 |
| 2017/0261213 | A1 * | 9/2017 | Park | F24C 7/085 |
| 2018/0202665 | A1 * | 7/2018 | Park | F24C 15/045 |
| 2019/0128533 | A1 * | 5/2019 | Bunzel | F24C 15/028 |

FOREIGN PATENT DOCUMENTS

| | | | | |
|---|---|---|---|---|
| BE | 1012535 | A4 * | 12/2000 | H01R 13/633 |
| FR | 2084656 | A5 * | 12/1971 | H01R 13/633 |
| WO | WO2017178366 | A1 | 10/2017 | |

* cited by examiner

*Primary Examiner* — Jorge A Pereiro
*Assistant Examiner* — Logan P Jones
(74) *Attorney, Agent, or Firm* — Dority & Manning, P.A.

(57) ABSTRACT

An oven appliance includes a cabinet and a chamber defined within the cabinet for receipt of food items for cooking. A door is rotatably mounted to the cabinet by a hinge. The oven appliance also includes a first cable extending within the cabinet and a second cable extending within the door. The hinge includes a door removal bracket which is movable between a locked position where the door is locked to the cabinet by the hinge and an unlocked position where the door is removable from the cabinet. The door removal bracket is connected to one of the first cable and the second cable such that the first cable and the second cable are disconnected by moving the door removal bracket from the locked position to the unlocked position.

20 Claims, 6 Drawing Sheets

AUTOMATIC DISCONNECT FOR CABLE IN OVEN APPLIANCE DOOR

FIELD OF THE INVENTION

The subject matter of the present disclosure relates generally to an oven appliance, such as an oven appliance with a door rotatably and removably attached to a cabinet. In particular, the present disclosure relates to an automatic disconnection feature for cables connected between the door and the cabinet when the door is removed from the cabinet.

BACKGROUND OF THE INVENTION

Oven appliances generally include a cabinet that defines a cooking chamber for cooking food items therein, such as by baking or broiling the food items. To heat the cooking chamber for cooking, oven appliances include one or more heating elements positioned at a top portion, a bottom portion, or both the top portion and the bottom portion of the cooking chamber. Some oven appliances also include a convection heating element and fan for convection cooking cycles. The heating element or elements may be used for various cycles of the oven appliance, such as a preheat cycle, a cooking cycle, or a self-cleaning cycle.

Oven appliances generally include a door rotatably mounted to the cabinet for selectively enclosing or providing access to the cooking chamber. Additionally, user controls or other user interface elements may be provided on or in the door. For example, a camera or touchscreen may be provided. Such elements may be connected to a controller of the oven appliance by a cord or cable. Typically, the door may be removable from the cabinet. However, removing the door may damage the cable connecting the user interface elements on or in the door to the controller.

Accordingly, an oven appliance with features for removing the door and automatically disconnecting a cable therein would be desirable.

BRIEF DESCRIPTION OF THE INVENTION

Aspects and advantages of the invention will be set forth in part in the following description, may be apparent from the description, or may be learned through practice of the invention.

In one exemplary embodiment, an oven appliance is provided. The oven appliance includes a cabinet defining a vertical direction, a lateral direction, and a transverse direction. The vertical, lateral, and transverse directions are mutually perpendicular. The cabinet includes a front portion spaced apart from a back portion along the transverse direction and a left side spaced apart from a right side along the lateral direction. A chamber is defined within the cabinet for receipt of food items for cooking. The chamber is accessible through an opening defined in the front portion of the cabinet. A door is rotatably mounted to the cabinet by a hinge. The door is rotatable between an open position and a closed position to selectively sealingly enclose the chamber. The oven appliance also includes a first cable extending within the cabinet and a second cable extending within the door. The door is removably mounted to the cabinet. The hinge includes a door removal bracket. The door removal bracket is movable between a locked position where the door is locked to the cabinet by the hinge and an unlocked position where the door is removable from the cabinet. A first connector of the first cable is connected to a second connector of the second cable when the door is locked to the cabinet, and the door removal bracket is connected to one of the first connector and the second connector such that the first connector and the second connector are disconnected by moving the door removal bracket from the locked position to the unlocked position.

In another exemplary embodiment, an oven appliance is provided. The oven appliance includes a cabinet comprising a front portion spaced apart from a back portion and a left side spaced apart from a right side. A chamber is defined within the cabinet for receipt of food items for cooking. The chamber is accessible through an opening defined in the front portion of the cabinet. A door is rotatably mounted to the cabinet by a hinge. The door is rotatable between an open position and a closed position to selectively sealingly enclose the chamber. The oven appliance also includes a first cable extending within the cabinet and a second cable extending within the door. The door is removably mounted to the cabinet. The hinge includes a door removal bracket. The door removal bracket is movable between a locked position where the door is locked to the cabinet by the hinge and an unlocked position where the door is removable from the cabinet. A first connector of the first cable is connected to a second connector of the second cable when the door is locked to the cabinet, and the door removal bracket is connected to one of the first connector and the second connector such that the first connector and the second connector are disconnected by moving the door removal bracket from the locked position to the unlocked position.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
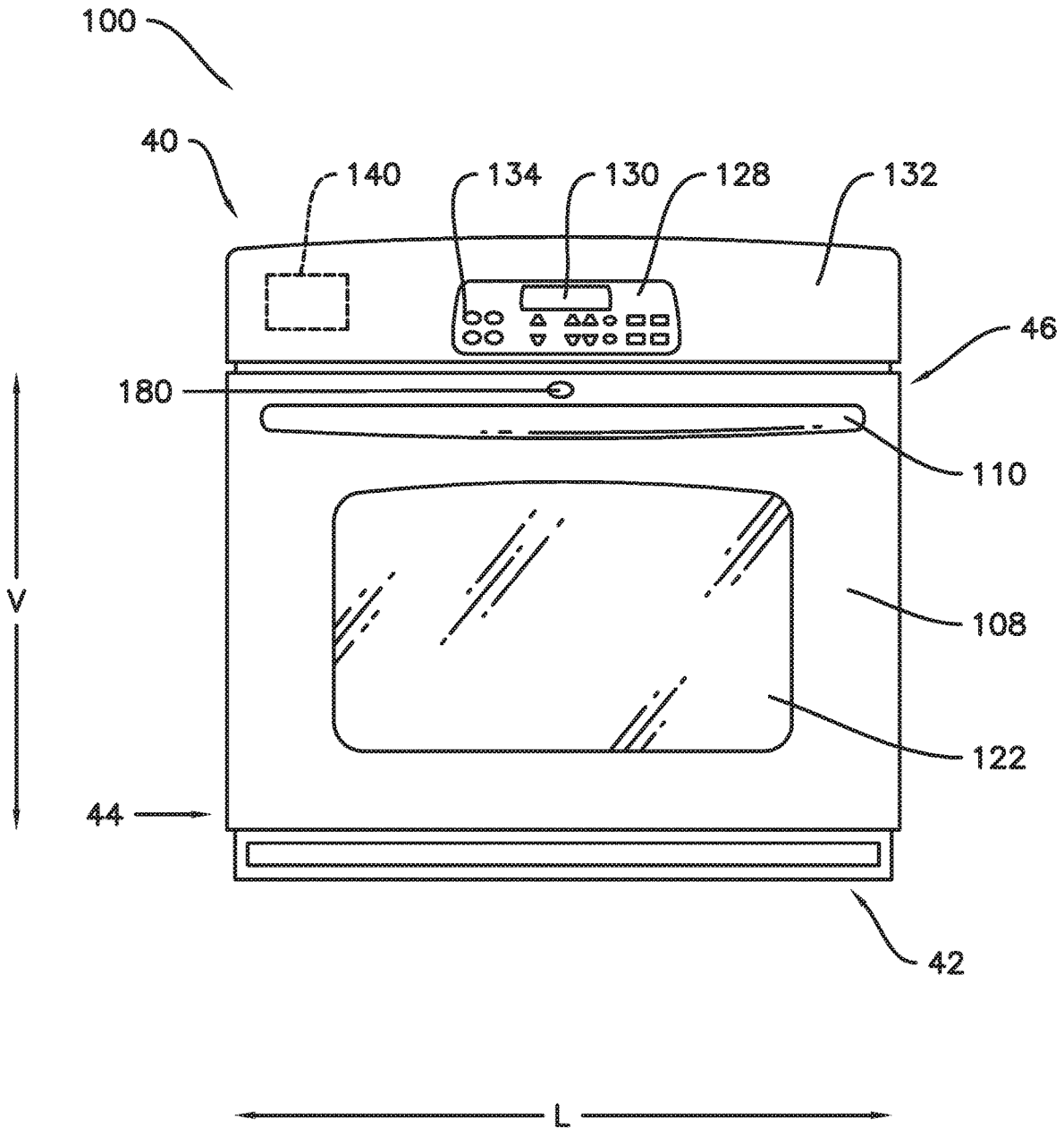
FIG. 1 provides a front view of an exemplary oven appliance according to one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. In the context of an angle or direction, such terms include values within ten degrees greater or less than the stated direction. For example, "generally vertical" includes directions within ten degrees of vertical in any direction, e.g., clockwise or counter-clockwise.

Figure 2:
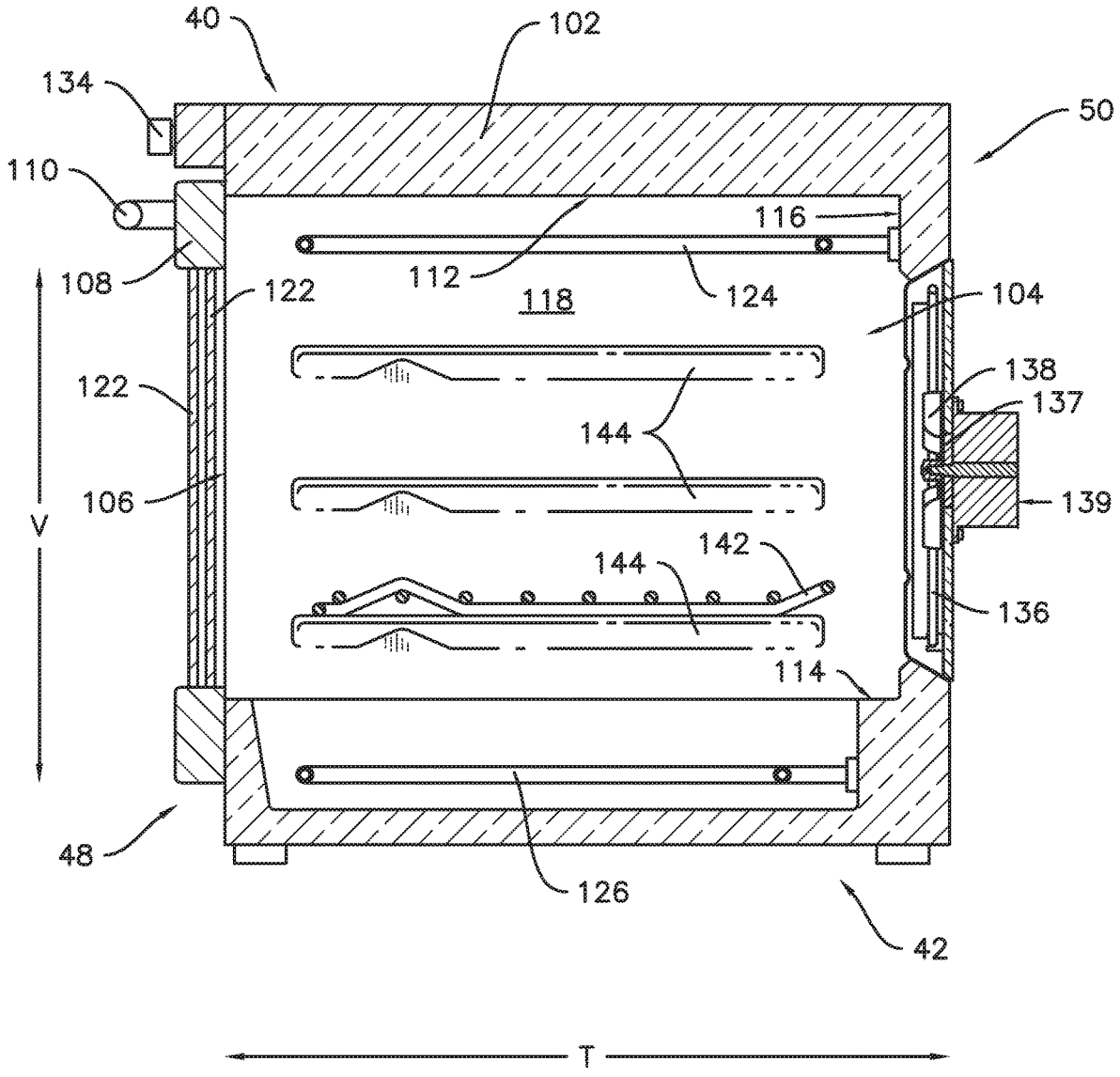
FIG. 2 is a cross-sectional view of the oven appliance of FIG. 1.
Figure 3:
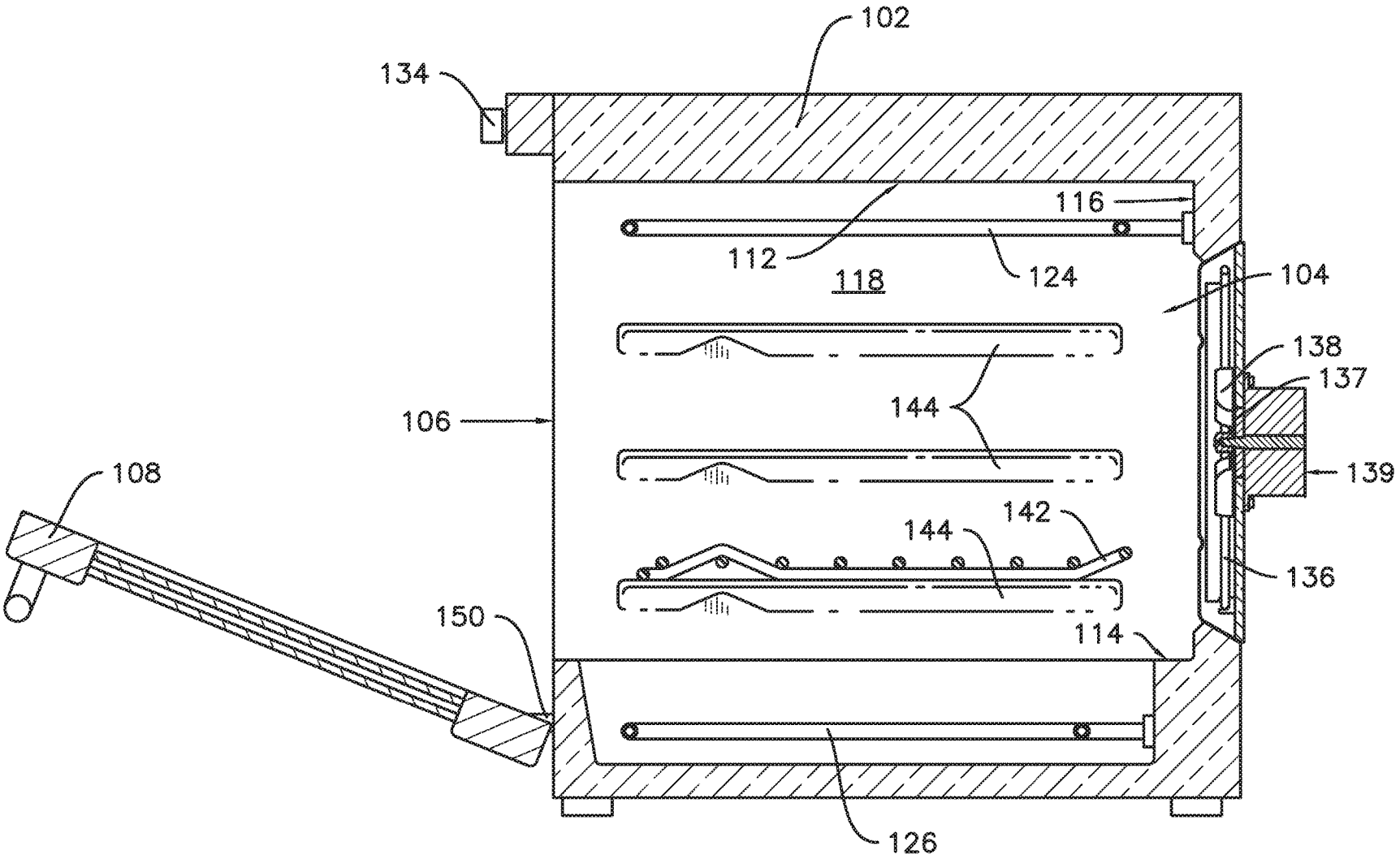
FIG. 3 provides a cross-sectional view of the oven appliance of FIG. 1 with a door in an open position.

FIGS. 1 through 3 illustrate an oven appliance 100 according to an exemplary embodiment of the present subject matter. Oven appliance 100 includes an insulated cabinet 102 which defines a vertical direction V, a lateral direction L, and a transverse direction T. The vertical, lateral, and transverse directions V, L, and T are mutually perpendicular and form an orthogonal direction system. Cabinet 102 extends between a top portion 40 and a bottom portion 42 along the vertical direction V. Cabinet 102 extends between a left side 44 and a right side 46 along the lateral direction L and between a front portion 48 and a back portion 50 along the transverse direction T.

Still referring to FIGS. 1 through 3, for this exemplary embodiment, oven appliance 100 includes an insulated cabinet 102 with an interior cooking chamber 104 defined by a top wall 112, a bottom wall 114, a back wall 116, and a pair of opposing side walls 118. Cooking chamber 104 is configured for the receipt of one or more food items to be cooked. Oven appliance 100 includes a door 108 pivotally mounted, e.g., with one or more hinges 150 (FIG. 3), to cabinet 102 at the opening 106 of cabinet 102 to permit selective access to cooking chamber 104 through opening 106. A handle 110 is mounted to door 108 and assists a user with opening and closing door 108. For example, a user can pull on handle 110 to open or close door 108 and access cooking chamber 104.

Oven appliance 100 can include a seal (not shown) between door 108 and cabinet 102 that assists with maintaining heat and cooking vapors within cooking chamber 104 when door 108 is closed as shown in FIGS. 1 and 2. Multiple parallel glass panes 122 provide for viewing the contents of cooking chamber 104 when door 108 is closed and assist with insulating cooking chamber 104. A baking rack 142 is positioned in cooking chamber 104 for the receipt of food items or utensils containing food items. Baking rack 142 is slidably received onto embossed ribs or sliding rails 144 such that rack 142 may be conveniently moved into and out of cooking chamber 104 when door 108 is open.

One or more heating elements may be included at the top, bottom, or both of cooking chamber 104 to provide heat to cooking chamber 104 for cooking. Such heating element(s) can be gas, electric, microwave, or a combination thereof. For example, in the embodiment shown in FIGS. 2 and 3, oven appliance 100 includes a top heating element 124 and a bottom heating element 126, where bottom heating element 126 is positioned adjacent to and below bottom wall 114. Other configurations with or without wall 114 may be used as well.

In the illustrated example embodiment, oven appliance 100 also has a convection heating element 136 and convection fan 138 positioned adjacent back wall 116 of cooking chamber 104. Convection fan 138 is powered by a convection fan motor 139. Further, convection fan 138 can be a variable speed fan—meaning the speed of fan 138 may be controlled or set anywhere between and including, e.g., zero and one hundred percent (0%-100%). In certain embodiments, oven appliance 100 may also include a bidirectional triode thyristor (not shown), i.e., a triode for alternating current (TRIAC), to regulate the operation of convection fan 138 such that the speed of fan 138 may be adjusted during operation of oven appliance 100. The speed of convection fan 138 can be determined by controller 140. In addition, a sensor 137 such as, e.g., a rotary encoder, a Hall effect sensor, or the like, may be included at the base of fan 138, for example, between fan 138 and motor 139 as shown in the exemplary embodiment of FIGS. 2 and 3, to sense the speed of fan 138. The speed of fan 138 may be measured in, e.g., revolutions per minute ("RPM"). In some embodiments, the convection fan 138 may be configured to rotate in two directions, e.g., a first direction of rotation and a second direction of rotation opposing the first direction of rotation. For example, in some embodiments, reversing the direction of rotation, e.g., from the first direction to the second direction or vice versa, may still direct air from the back of the cavity. As another example, in some embodiments reversing the direction results in air being directed from the top and/or sides of the cavity rather than the back of the cavity. Additionally, the convection heating features are optional and are shown and described herein solely by way of example. In other embodiments the oven appliance 100 may include different convection heating features or may not include convection heating features at all.

In various embodiments, more than one convection heater, e.g., more than one convection heating elements 136 and/or convection fans 138, may be provided. In such embodiments, the number of convection fans and convection heaters may be the same or may differ, e.g., more than one convection heating element 136 may be associated with a single convection fan 138. Similarly, more than one top heating element 124 and/or more than one bottom heating element 126 may be provided in various combinations, e.g., one top heating element 124 with two or more bottom heating elements 126, two or more top heating elements 124 with no bottom heating element 126, etc.

Oven appliance 100 includes a user interface 128 having a display 130 positioned on an interface panel 132 and having a variety of controls 134. Interface 128 allows the user to select various options for the operation of oven 100 including, e.g., various cooking and cleaning cycles. One or more additional user engagement elements, such as a camera 180 (FIG. 1) may also be provided. For example, as shown in FIG. 1, the camera 180 may be provided in the door 108, whereas the user interface 128 is generally disposed on and/or in the cabinet 102. Operation of oven appliance 100 can be regulated by a controller 140 that is operatively coupled to, i.e., in communication with, user interface 128, heating elements 124, 126, user engagement elements, e.g., camera 180, and other components of oven 100 as will be further described.

For example, in response to user manipulation of the user interface 128, controller 140 can operate the heating element(s). Controller 140 can receive measurements from one or more temperature sensors (not shown) which are in or in thermal communication with the cooking chamber 104. Controller 140 may also provide information such as a status indicator, e.g., a temperature indication, to the user with display 130. Controller 140 can also be provided with other features as will be further described herein.

Controller 140 may include a memory and one or more processing devices such as microprocessors, CPUs, or the like, such as general or special purpose microprocessors operable to execute programming instructions or micro-control code associated with operation of oven appliance 100. The memory may represent random access memory such as DRAM or read only memory such as ROM or FLASH. In one embodiment, the processor executes programming instructions stored in memory. The memory may be a separate component from the processor or may be included onboard within the processor. The memory can store information accessible by the processor(s), including instructions that can be executed by processor(s). For example, the instructions can be software or any set of instructions that when executed by the processor(s), cause the processor(s) to perform operations. For the embodiment depicted, the instructions may include a software package configured to operate the system, e.g., to execute exemplary methods of operating the oven appliance 100. Controller 140 may also be or include the capabilities of either a proportional (P), proportional-integral (PI), or proportional-integral-derivative (PID) control for feedback-based control implemented with, e.g., temperature feedback from one or more sensors such as temperature sensors and/or probes, etc.

Controller 140 may be positioned in a variety of locations throughout oven appliance 100. In the illustrated embodiment, controller 140 is located next to user interface 128 within interface panel 132. In other embodiments, controller 140 may be located under or next to the user interface 128, otherwise within interface panel 132, or at any other appropriate location with respect to oven appliance 100. Generally, controller 140 will be positioned within the cabinet 102. In the embodiment illustrated in FIG. 1, input/output ("I/O") signals are routed between controller 140 and various operational components of oven appliance 100 such as heating elements 124, 126, 136, convection fan 138, controls 134, display 130, camera 180 in the door 108, alarms, and/or other components as may be provided. In one embodiment, user interface 128 may represent a general purpose I/O ("GPIO") device or functional block.

Although shown with touch type controls 134, it should be understood that controls 134 and the configuration of oven appliance 100 shown in FIG. 1 is provided by way of example only. More specifically, user interface 128 may include various input components, such as one or more of a variety of electrical, mechanical, or electro-mechanical input devices including rotary dials, push buttons, and touch pads. User interface 128 may include other display components, such as a digital or analog display device designed to provide operational feedback to a user. User interface 128 may be in communication with controller 140 via one or more signal lines or shared communication busses.

While oven 100 is shown as a wall oven, the present invention could also be used with other cooking appliances such as, e.g., a stand-alone oven, an oven with a stove-top, or other configurations of such ovens. Numerous variations in the oven configuration are possible within the scope of the present subject matter. For example, variations in the type and/or layout of the controls 134, as mentioned above, are possible. As another example, the oven appliance 100 may include multiple doors 108 instead of or in addition to the single door 108 illustrated. Such examples include a dual cavity oven, a French door oven, and others. As still another example, one or more of the illustrated electrical resistance heating elements may be substituted with gas burners or microwave heating elements, or any other suitable heating elements. The examples described herein are provided by way of illustration only and without limitation.

Figure 4:
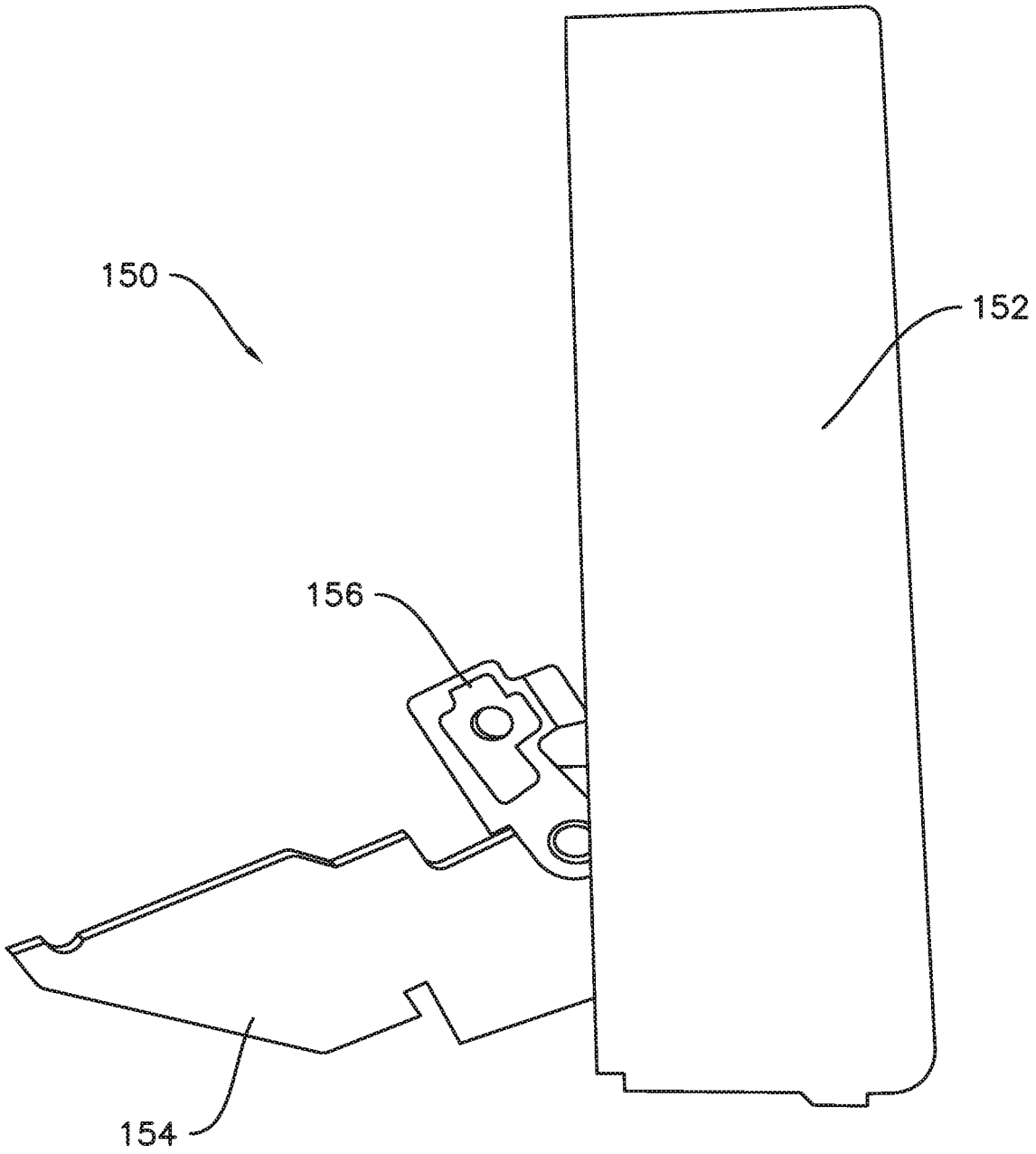
FIG. 4 provides a side view of a door hinge for an oven appliance according to one or more embodiments of the present subject matter.
Figure 5:
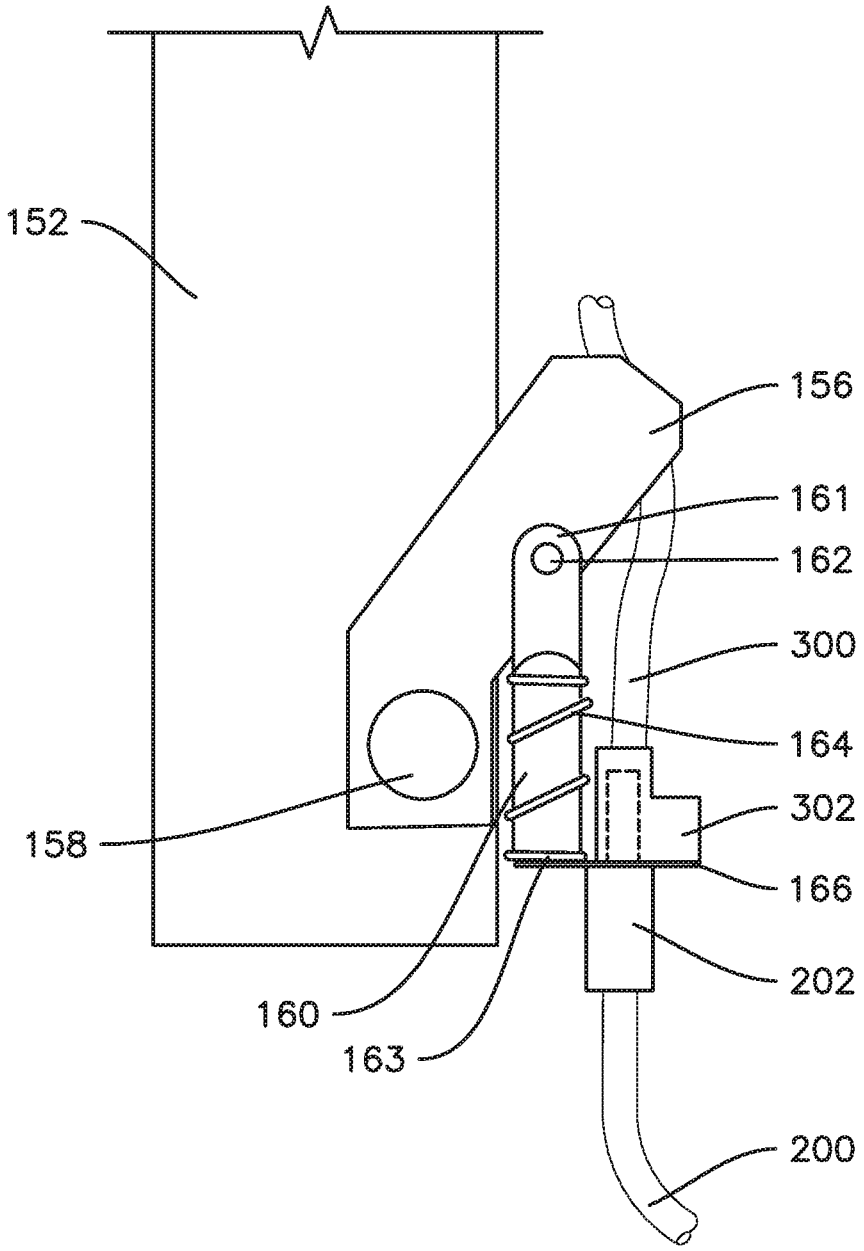
FIG. 5 provides a view of a door removal bracket of the hinge of FIG. 4 with the door removal bracket in a locked position.
Figure 6:
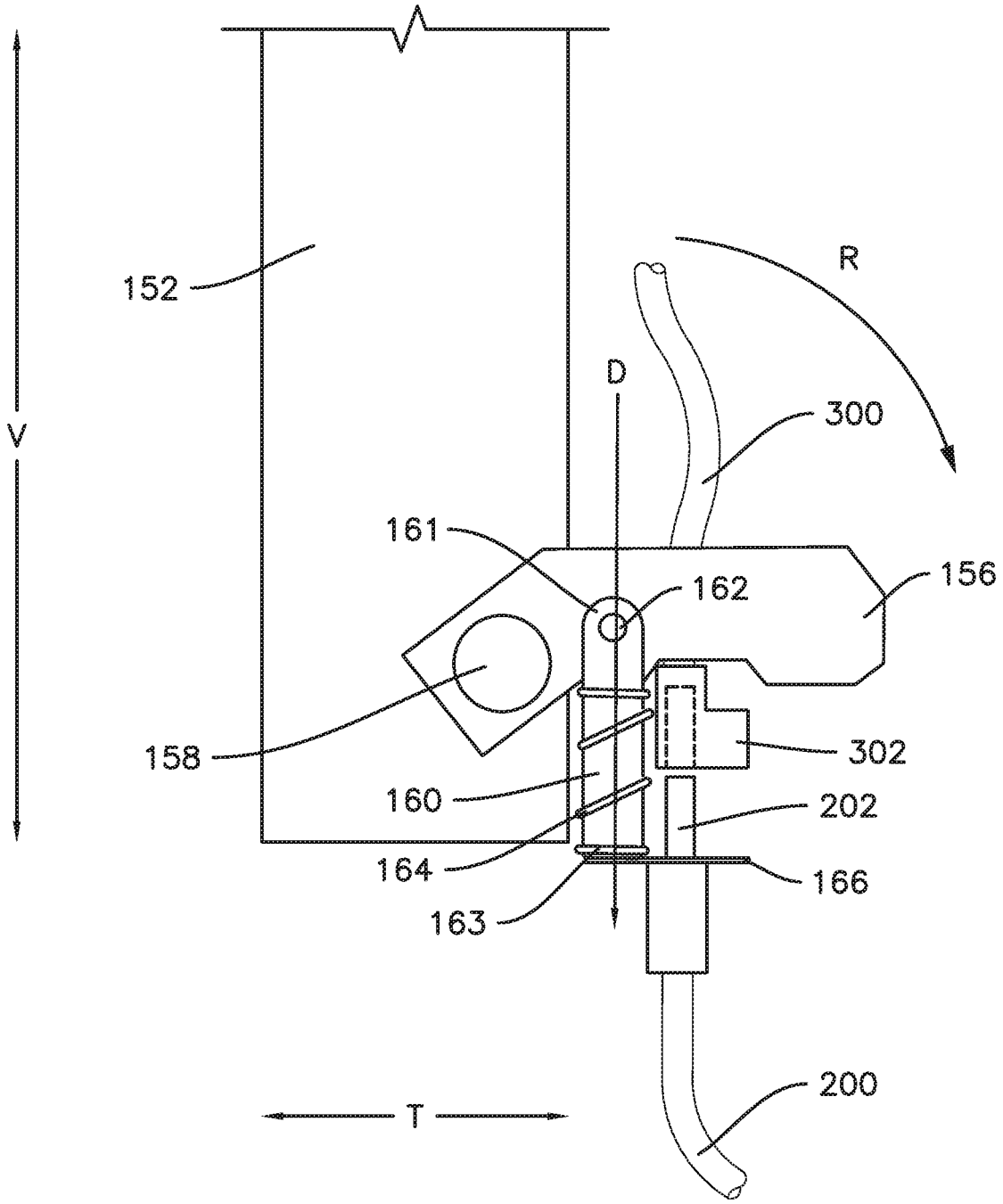
FIG. 6 provides a view of the door removal bracket with the door removal bracket in an unlocked position.

FIG. 4 illustrates an exemplary hinge 150 which may be one of a pair of hinges 150 provided on each side (e.g., a left side and a right side spaced apart along the lateral direction L as shown in FIG. 1) of the door 108 (FIGS. 1-3). As shown in FIG. 4, the hinge 150 may include a hinge body 152 which may be connected to the door 108 and a hinge arm 154 which may be engaged by hinge receivers (not shown) in the cabinet 102 when the door 108 is connected to the cabinet 102 by the hinge 150. The door 108 may be selectively locked to the cabinet 102 by the hinge 150. In particular, the hinge 150 may include a door removal bracket 156 which is movable between a locked position where the door 108 is locked to the cabinet 102 by the hinge 150 and an unlocked position where the door 108 is removable from the cabinet 102. The hinge removal bracket 156 may be rotatably connected to the hinge body 152 of the hinge 150 by a pin 158 (FIGS. 5 and 6). As a result of this connection, the door removal bracket 156 may be rotatable about the pin 158 between the locked position and the unlocked position. For example, the door 108 may be removed from the cabinet 102 by rotating the door 108 to a fully open position, moving, e.g., rotating, the door removal bracket 156 to the unlocked position, and disengaging the hinge arm 154 from the hinge receivers in the cabinet 102.

Turning now to FIGS. 5 and 6, the oven appliance 100 may also include a first cable 200 and a second cable 300. The cables 200 and 300 may provide a connection between the controller 140 which, as mentioned above, is located within the cabinet 102, and one or more user engagement elements, such as camera 180, located on or in the door 108. The particular user engagement element or elements which may be provided on or in the door 108, e.g., a camera and/or touchscreen, etc., are generally understood by those of skill in the art and the specific structure and function of such elements are not shown or described further herein for the sake of concision and clarity. Thus, the first cable 200 may be located within the cabinet 102, e.g., may extend within the cabinet 102 between the controller 140 and a first connector 202, and the second cable 300 may be located within the door 108, e.g., may extend within the door 108 from a second connector 302 to one or more user engagement elements in or on the door 108, e.g., the second cable 300 may extend to the camera 180.

FIG. 5 illustrates the hinge 150 with the door removal bracket 156 in the locked position. When the door removal bracket 156 is in the locked position, the door 108 is generally locked to the cabinet 102, e.g., the door 108 is movable relative to the cabinet 102, e.g., rotatable between the open and closed positions described above, but is not removable from the cabinet 102 without damaging or destroying one or more of the door 108, cabinet 102, and/or the hinge 150. Also when the door 108 is locked to the cabinet 102, e.g., when the door removal bracket 156 is in the locked position, the first connector 202 of the first cable 200 may be connected to the second connector 302 of the second cable 300. Accordingly, the first and second cables 200 and 300 may provide communication, e.g., transmission of data signals, between the controller 140 and one or more user engagement elements on or in the door 108, as is generally understood in the art.

Turning now specifically to FIG. 6, the door removal bracket 156 may be connected to one of the first connector 202 and the second connector 302. As a result of such connection, when the door removal bracket 156 is moved, e.g., rotated as shown by the arrow R in FIG. 6, from the locked position (FIG. 5) to the unlocked position (FIG. 6), the first connector 202 and the second connector 302 may thereby be disconnected, as shown in FIG. 6.

For example, as may be seen in FIGS. 5 and 6, the door removal bracket 156 may be connected to the first connector 202. In particular, the door removal bracket 156 may be connected to the first connector 202 (or, in other embodiments, the second connector 302) through a plunger 160 connected, e.g., directly connected, to the door removal bracket 156 and a flange or plate 166 connected, e.g., directly connected, to the first connector 202. In such embodiments, the plunger 160 may be directly connected to the door removal bracket 156 by a pin 162 at a first end 161 of the plunger 160 such that the plunger 160 is rotatable relative to the door removal bracket 156. For example, as best seen in FIG. 6, the connection through pin 162 may permit the plunger 160 to translate along a linear path, e.g., as shown by the arrow D in FIG. 6, when the door removal bracket 156 rotates from the locked position to the unlocked position, e.g., as shown by the arrow R in FIG. 6.

The first connector 202 and the second connector 302 may be aligned along a first direction, e.g., the vertical direction V, as illustrated in FIG. 6, and the door removal bracket 156 may rotate about a second direction generally perpendicular to the first direction, e.g., the lateral direction L as illustrated in FIG. 6, between the locked position and the unlocked position. The first and second connectors 202 and 302 may also be aligned along, e.g., the transverse direction T, which is also perpendicular to the lateral direction L. In such embodiments, the plunger 160 may move along the first direction, e.g., downward along the vertical direction V as shown by arrow D in FIG. 6, when the door removal bracket 156 rotates, e.g., about the lateral direction L as shown by arrow R in FIG. 6, from the locked position to the unlocked position. The plunger 160, e.g., a second end 163 thereof, may directly contact the flange 166 of the first connector 202. As a result of such contact, when the plunger 160 moves along the first direction as the door removal bracket 156 rotates about the second direction to the unlocked position, the plunger 160, e.g., the second end 163 thereof, may engage and bear on the flange 166 to disconnect the first connector 202 and the second connector 302, e.g., the plunger 160 may push on the flange 166 to move the first connector 202 away from the second connector 302 and thereby to unplug the first and second connectors 202 and 302.

In some embodiments, the hinge 150 may also include a biasing element, e.g., spring 164, as shown in FIGS. 5 and 6. For example, in the illustrated embodiment, the biasing element is a coil spring 164 encircling (e.g., helically wrapped around) the plunger 160. The spring 164 may bias the door removal bracket 156 towards the locked position.

As will be understood by those of skill in the art, the first and second cables 200 and 300 may be any suitable type of cable and may include any suitable type of connector. In some embodiments, for example as illustrated in FIGS. 5 and 6, the first cable 200 and the second cable 300 may be universal serial bus (USB) cables and the first connector 202 and the second connector 302 may be universal serial bus (USB) connectors. For example, the first connector 202 may be a male universal serial bus connector and the second connector 302 may be a female universal serial bus connector.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An oven appliance, comprising:

a cabinet defining a vertical direction, a lateral direction, and a transverse direction, the vertical, lateral, and transverse directions being mutually perpendicular, the cabinet comprising a front portion spaced apart from a back portion along the transverse direction and a left side spaced apart from a right side along the lateral direction;

a chamber defined within the cabinet for receipt of food items for cooking, the chamber being accessible through an opening defined in the front portion of the cabinet;

a door rotatably mounted to the cabinet by a hinge, the door rotatable between an open position and a closed position to selectively sealingly enclose the chamber; and a first cable extending within the cabinet and a second cable extending within the door;

wherein the door is removably mounted to the cabinet, the hinge comprises a door removal bracket, and the door removal bracket is movable between a locked position where the door is locked to the cabinet by the hinge and an unlocked position where the door is removable from the cabinet by translating the door along the transverse direction away from the cabinet, wherein a first connector of the first cable is connected to a second connector of the second cable when the door is locked to the cabinet, and wherein the door removal bracket is connected to one of the first connector and the second connector whereby the first connector and the second connector are disconnected by moving the door removal bracket from the locked position to the unlocked position, wherein the first connector and the second connector are aligned along the vertical direction such that the one of the first connector and the second connector translates along the vertical direction relative to the other of the first connector and the second connector to disconnect the first connector and the second connector.

2. The oven appliance of claim 1, wherein the door removal bracket is connected to the one of the first connector and the second connector by a plunger.

3. The oven appliance of claim 2, wherein the door removal bracket rotates between the locked position and the unlocked position, and wherein the plunger is connected to the door removal bracket by a pin, whereby the plunger translates along a linear path when the door removal bracket rotates from the locked position to the unlocked position.

4. The oven appliance of claim 2, wherein the plunger contacts a flange of the one of the first connector and the second connector.

5. The oven appliance of claim 1, wherein the door removal bracket rotates about the lateral direction between the locked position and the unlocked position, wherein the door removal bracket is connected to the one of the first connector and the second connector by a plunger, wherein the plunger moves downward along the vertical direction when the door removal bracket rotates from the locked position to the unlocked position to disconnect the first connector and the second connector.

6. The oven appliance of claim 1, wherein the door removal bracket is connected to the one of the first connector and the second connector by a plunger, a first end of the plunger connected to the door removal bracket and a second end of the plunger contacting a flange of the one of the first connector and the second connector.

7. The oven appliance of claim 6, wherein the door removal bracket is rotatably connected to a hinge body of the hinge by a first pin, whereby the door removal bracket is rotatable about the first pin between the locked position and the unlocked position and wherein the first end of the plunger is connected to the door removal bracket by a second pin, whereby the plunger translates along a linear path when the door removal bracket rotates from the locked position to the unlocked position and the second end whereby the second end of the plunger engages the flange to disconnect the first connector and the second connector.

8. The oven appliance of claim 1, wherein the hinge further comprises a spring, the spring biasing the door removal bracket towards the locked position.

9. The oven appliance of claim 1, wherein the first cable and the second cable are universal serial bus cables and the first connector and the second connector are universal serial bus connectors.

10. The oven appliance of claim 1, wherein the first connector is a male universal serial bus connector and the second connector is a female universal serial bus connector.

11. The oven appliance of claim 1, wherein the door removal bracket is connected to the first connector whereby the first connector moves away from the second connector when the door removal bracket moves from the locked position to the unlocked position.

12. An oven appliance, comprising:

a cabinet comprising a front portion spaced apart from a back portion and a left side spaced apart from a right side;

a chamber defined within the cabinet for receipt of food items for cooking, the chamber being accessible through an opening defined in the front portion of the cabinet;

a door rotatably mounted to the cabinet by a hinge, the door rotatable between an open position and a closed position to selectively sealingly enclose the chamber; and a first cable extending within the cabinet and a second cable extending within the door;

wherein the door is removably mounted to the cabinet, the hinge comprising a door removal bracket, the door removal bracket movable between a locked position where the door is locked to the cabinet by the hinge and an unlocked position where the door is removable from the cabinet by translating the door along a first direction away from the cabinet, wherein a first connector of the first cable is connected to a second connector of the second cable when the door is locked to the cabinet, and wherein the door removal bracket is connected to one of the first connector and the second connector whereby the first connector and the second connector are disconnected by moving the door removal bracket from the locked position to the unlocked position, wherein the first connector and the second connector are aligned along a second direction which is not parallel to the first direction such that the one of the first connector and the second connector translates along the second direction relative to the other of the first connector and the second connector to disconnect the first connector and the second connector.

13. The oven appliance of claim 12, wherein the door removal bracket is connected to the one of the first connector and the second connector by a plunger.

14. The oven appliance of claim 13, wherein the door removal bracket rotates between the locked position and the unlocked position, and wherein the plunger is connected to the door removal bracket by a pin, whereby the plunger translates along a linear path when the door removal bracket rotates from the locked position to the unlocked position.

15. The oven appliance of claim 13, wherein the plunger contacts a flange of the one of the first connector and the second connector.

16. The oven appliance of claim 12, wherein the door removal bracket is connected to the one of the first connector and the second connector by a plunger, a first end of the plunger connected to the door removal bracket and a second end of the plunger contacting a flange of the one of the first connector and the second connector.

17. The oven appliance of claim 16, wherein the door removal bracket is rotatably connected to a hinge body of the hinge by a first pin, whereby the door removal bracket is rotatable about the first pin between the locked position and the unlocked position and wherein the first end of the plunger is connected to the door removal bracket by a second pin, whereby the plunger translates along a linear path when the door removal bracket rotates from the locked position to the unlocked position and the second end whereby the second end of the plunger engages the flange to disconnect the first connector and the second connector.

18. The oven appliance of claim 12, wherein the hinge further comprises a spring, the spring biasing the door removal bracket towards the locked position.

19. The oven appliance of claim 12, wherein the first connector is a male universal serial bus connector and the second connector is a female universal serial bus connector.

20. The oven appliance of claim 12, wherein the door removal bracket is connected to the first connector whereby the first connector moves away from the second connector when the door removal bracket moves from the locked position to the unlocked position.

* * * * *